United States Patent [19]

Voreck, Jr.

[11] 4,421,578

[45] Dec. 20, 1983

[54] CASTABLE HIGH EXPLOSIVE COMPOSITIONS OF LOW SENSITIVITY

[75] Inventor: Wallace E. Voreck, Jr., Sparta, N.J.

[73] Assignee: The United States of America as represented by the Secretary of the Army, Washington, D.C.

[21] Appl. No.: 399,391

[22] Filed: Jul. 19, 1982

[51] Int. Cl.[3] ..... C06B 45/00

[52] U.S. Cl. ..... 149/2; 149/21; 149/41; 149/47; 149/62; 149/88; 149/92; 149/93; 149/105; 149/109.6

[58] Field of Search ..... 149/2, 21, 41, 47, 62, 149/88, 92, 93, 105, 109.6

[56] References Cited

U.S. PATENT DOCUMENTS 3,471,346 10/1969 Lyerly ..... 149/62
3,617,404 11/1971 Lyerly ..... 149/62
4,220,087 9/1980 Posson ..... 102/275.6
4,300,962 11/1981 Stinecipher et al. ..... 149/92
4,353,758 10/1982 Akst et al. ..... 149/92

*Primary Examiner*—Stephen J. Lechert, Jr.
*Attorney, Agent, or Firm*—Robert P. Gibson; Anthony T. Lane; A. Victor Erkkila

[57] ABSTRACT

A high explosive composition comprising
- 2 to 57% ammonium nitrate
- 2 to 50% ethylenediamine dinitrate
- 1 to 10% potassium nitrate
- 1 to 80% nitroguanidine These explosive compositions possess physical and explosive properties comparable to those of explosive compositions based on TNT (2,4,6-trinitrotoluene); but they are relatively insensitive and less costly to manufacture and can be loaded into projectiles with existing melt/cast loading facilities.

9 Claims, No Drawings

CASTABLE HIGH EXPLOSIVE COMPOSITIONS OF LOW SENSITIVITY

GOVERNMENT RIGHTS

The invention described herein may be manufactured, used and licensed by or for the Government for Governmental purposes without the payment to me of any royalties thereon.

BACKGROUND OF THE INVENTION

TNT (2,4,6-trinitrotoluene) and mixtures of TNT with RDX (such as Composition B) or with ammonium nitrate (such as Minols) are commonly employed as the high explosive charge in artillery projectiles. Such explosive compositions are usually loaded into projectiles by melt/cast operations, wherein the composition is melted, poured into the projectile and allowed to cool and solidify therein. It is also known to produce cast high explosive compositions by solidification of a molten mixture of ammonium nitrate (AN) and ethylenediamine dinitrate (EDDN), including low-melting eutectic mixtures thereof, which may contain other explosive additives, such as RDX (see U.S. Pat. No. 4,110,136).

It is an object of the present invention to provide castable high explosive compositions containing ammonium nitrate without the use of TNT, which as compared with TNT-based explosive compositions, possess similar physical and explosive properties and can be loaded into projectiles with existing melt/cast loading facilities, but are relatively insensitive and inexpensive to manufacture. Other objects will become apparent from the following description of the invention.

SUMMARY OF THE INVENTION

I have discovered that the foregoing objects can be achieved by means of novel explosive compositions comprising a mixture consisting essentially of about 2 to 57 wt. % ammonium nitrate (AN)
2 to 50 wt. % ethylenediamine dinitrate (EDDN)
1 to 10 wt. % potassium nitrate (KN)
1 to 80 wt. % nitroguanidine (NQ)

DETAILED DESCRIPTION OF THE INVENTION

As disclosed in U.S. Pat. No. 4,110,136, a eutectic mixture of AN and EDDN (1:1 weight ratio) melts at approximately 103° C. I have unexpectedly found that the addition of NQ to a mixture of AN and EDDN produces a eutectic mixture of still lower melting point, which freezes with supercooling and sudden crystallization, and provides a cast explosive having a finer crystal structure and greater mechanical strength. Further, the irreversible growth of AN on temperature cycling, which is due to the formation of a low density polymorph of AN known as Phase IV, can be prevented in the novel explosive compositions of the present invention by incorporating KN in an amount of approximately 15% by weight of the AN/KN mixture. The KN forms a true co-crystal with the AN, which contins approximately 15 wt. % of KN and has a melting point of 159° C. and hence is considered as one phase of the ternary phase diagram of the explosive compositions of this invention, which are referred to as NEAK compositions (the acronym NEAK represents the first letters of NQ, EDDN, AN and KN). The use of more than 15% KN is similarly effective for preventing the formation of phase IV AN, but is less desirable, since the excess KN would reduce the explosive output of the high explosive composition. The use of substantially less than 15% KN is insufficient to combine with all of the AN present in the explosive composition with the result that substantial amounts of the AN are not protected against the formation of phase IV, which is less desirable.

To be compatible with existing melt/cast loading facilities it is necessary that the melt/cast explosive formulation possess a melting point below 100° C. and a freezing point above 80° C. I have found that these requirements can be achieved by the novel compositions of the present invention which contain a eutectic mixture consisting of 57.1% AN, 25.3% EDDN, 10.1% KN and 7.5% NQ by weight. This eutectic mixture melts at 98.9° C., has a low viscosity (like TNT), and freezes with supercooling at 82° C. The liquid eutectic mixture provides the liquid phase in the explosive compositions of the present invention, wherein other ingredients or additional amounts of the NEAK ingredients are dispersed at the eutectic temperature, and may be dissolved or suspended therein at higher temperatures. The eutectic mixture shrinks on freezing by about the same amount (about 6%) as TNT, and yields solid composition possessing a very fine grained, intimate mixture of fuel and oxidizer ingredients, which achieves a superior explosive performance than can be obtained by mechanically mixing the powdered ingredients. Such shrinkage can be reduced by incorporating additional amounts of finely divided aluminum, or a solid explosive such as NQ, RDX, or HMX, which also increase the explosive performance of the composition.

The explosive compositions of the present invention can be prepared by heating a mixture of the components in the presence or absence of an inert liquid diluent in which the components are insoluble, e.g. perchlorethylene, to melt the components together. When an organic diluent, such as perchloroethylene is used, the mixture is cooled to solidify the explosive composition which can then be separated from the perchloroethylene by filtration or decantation. When water is present, the water can be separated by distillation, preferably under vacuum, after which the dehydrated explosive composition is cooled and solidified. A preferred method for manufacturing the explosive compositions of the present invention comprises preparing the EDDN by slowly adding the ED to a mixture of the AN, KN and aqueous nitric acid, whereby the mixture helps absorb the heat of the reaction to form EDDN, after which the NQ and other ingredients can be added and the water removed by distillation.

The oxygen balance and explosive performance can be improved by increasing the amount of EDDN over that present in the eutectic mixture, preferably to about 46% and reducing the amounts of AN and KN, preferably to about 39% and 7% respectively. The resulting composition as well as other explosive compositions of the invention are of low sensitivity, i.e. are difficult to detonate. The sensitivity of such compositions can be increased by addition of about 1 to 2 percent by weight of hollow glass microspheres or RDX of fine particle size. Further, the explosive performance of the novel mixtures of AN, EDDN, KN and NQ can be increased by the addition, preferably to the melted mixtures prior to the casting thereof, of finely divided high explosives, such as RDX (1,3,5-trinitro-1,3,5-triazacylohexane, HMX (1,3,5,7-tetranitro-1,3,5,7-tetraazacycloctane), PETN (pentaerythritol tetranitrate), NQ and TNT in amounts up to about 95% by weight of said mixture of AN, EDDN, KN and NQ. Also, finely divided metal powders, e.g. aluminum, can be added in amounts up to about 25 wt. % to increase the blast effect of the high explosive compositions of the present invention.

The following examples provide further specific illustrations of the explosive compositions of the present invention.

EXAMPLE 1

1769 grams of ammonium nitrate and 317 grams of potassium nitrate were charged into a stainless steel reactor equipped with an agitator and a jacket which could be heated to 120° C. with 15 psi steam or cooled with water. 2175 grams of 65% nitric acid ($HNO_3$) were then added after which 681 grams of ethylenediamine (ED) were slowly introduced with agitation, causing the temperature of the reactor contents to rise 45° C. to about 65° C. The resulting mixure had a pH of 4–6. 363 grams of nitroguanidine were then added and the mixture was heated to 120° C. to distill off water, initially under ordinary pressure and finally under vacuum of 28 mm Hg or less at 120° C. to complete the removal of water. The mixture was cooled to 100° C. and 45 grams of hollow glass spheres (15 microns diameter, 0.3 gr./cc density) were stirred in to increase the sensitivity of the composition to detonation, after which the liquid composition was cast into preheated containers and cooled slowly until solidified. Note. In the foregoing example, by adding 10–20 liters of perchloroethylene to the mixture following the addition of nitroguanidine, the water can be removed by distillation as an azeotrope boiling at 88° C. without the use of a vacuum. By suddenly cooling the dehydrated mixture by addition of cold perchloroethylene, the explosive composition is precipitated as granules, which can be separated by filtration from the perchloroethylene, oven dried to remove adhering solvent, and employed for making pressed charges.

The cast explosive composition thus obtained has the following composition (excluding the glass spheres):

ethylenediamine dinitrate: 46%
ammonium nitrate: 39%
nitroguanidine: 8%
potassium nitrate: 7%

It possessed the following properties as such and mixed with RDX powder.

Cast density 1.64 gm/cc; crystal density 1.687 gm/cc
Melting point 98° C., Freezing point 81° C.
Detonation velocity 8.02 mm/microsecond (No RDX), 8.17 mm/microsecond (15% RDX added)
Vacuum stability (a)—40 hours at 100° C. = 1.45 cc/5 gm.
Impact sensitivity (b)—Type 12, 2½ Kg. = 55 cm (No RDX), 42 cm (25% RDX, added), 36 cm for Composition B,
Picatinny Arsenal Friction Sensitiveness Test (c):
Steel Shoe—No reaction (No RDX)
Steel Shoe—Explodes (25% RDX added)
Fiber Shoe—No reaction (25% RDX added)
NOL Large Scale Gap Test (d): Gap, inches
No dent at zero gap (below failure diameter) (No RDX) 2.79 inches (25% RDX added)

(a) Vacuum Stability Test
R. F. Walker, Editor, "Volume IV pages 3–19 through 3–22, Joint Service Safety and Performance Manual for Qualification of Explosives for Military Use," AD-AO-86259, Explosives Division, Feltman Research Lab, Picatinny Arsenal, Dover, NJ May 1972
(b) U.S. Naval Ordnance Laboratory, Impact Test, pages 11–32. G. R. Walker, Editor, TTCP Panel 0–2 Working Group "Manual of Sensitivity Tests," Canadian Armament Research & Development Establishment, February 1966.
(c) Picatinny Arsenal Friction Test, pages 97–102 ibid
(d) Large Scale Gap Test pages 137–142, ibid.

EXAMPLE 2

A NEAK explosive composition of the following composition was prepared in a manner similar to that described in example 1:

nitroguanidine: 49.1 wt %
ethylenediamine dinitrate: 25 wt %
ammonium nitrate: 21.15 wt %
potassium nitrate: 3.75 wt %
glass microspheres: 0.9 wt %

The foregoing cast explosive composition possessed the following properties in comparison with cast TNT and Composition B, as shown in the following table.

TABLE 1

| Explosive | NEAK | TNT | Comp B |
|---|---|---|---|
| Maximum Density, GM/CC | 1.64 | 1.65 | 1.74 |
| Detonation Velocity, MM/Micro-Sec | 7.03 (1.2" dia.)<br>7.42 (1.4" dia.) | 6.93 | 7.84 |
| Density Tested, GM/CC | 1.59 | 1.64 | 1.65 |
| Calculated Velocity, MM/Micro-Sec | 8.67 | | 7.99 |
| Calculated Pressure (CJ), KBAR | 293 | 207 | 295 |
| CAP Sensitivity (No. 8) | No Detonation | Detonation | |
| Shock Sensitivity, LSGT, GAP, In. (DATB* = 1.32, TATB** = 0.78) | 0.90,0.99 | 1.83 | 2.38 |
| Impact Sensitivity, Type 12, CM (TNT = 56, DATB & TATB over 240) | 104,92 | 56 | 41 |

*DATB = 1,3-diamino-2,4,6-trinitrobenzene
**TATB = 1,3,5-triamino-2,4,6-trinitrobenzene The following table sets forth a comparison of the properties of (a) compositions obtained by melting the composition of example 1, referred to by the acronym NEAK, admixing with finely divided RDX, NQ or RDX+aluminum powder, and casting the resulting composition, and (b) other explosive compositions.

TABLE 2

| FORMULATION | DENSITY GM/CC | LSGT INCHES | VAC. STAB. (CC/5 GM) | 50% IMPACT | FRICTION PENDULUM STEEL SHOE |
|---|---|---|---|---|---|
| NEAK + 25% RDX | 1.61 | 2.79 | 1.45 | 42½ | Exploded |
| NEAK + 20% NQ | 1.66 | 0.635 | 1.33 | 52¼ | Crackled |
| NEAK + 45% NQ | 1.59 | 0.95 | 0.29 | 92 | No Reaction |

TABLE 2-continued

| FORMULATION | DENSITY GM/CC | LSGT INCHES | VAC. STAB. (CC/5 GM) | 50% IMPACT | FRICTION PENDULUM STEEL SHOE |
|---|---|---|---|---|---|
| NEAK + 15% Al + 10% RDX | 1.75 | | 1.20 | 27½ | No Reaction |
| EAK | 1.64 | 0 | 0.37 | 55½ | No Reaction |
| EAK + 15% Al | 1.72 | 0 | 0.44 | 39 | No Reaction |
| Comp. B | 1.65 | 2.38 | 0.3 | 36 | No Reaction |
| RDX (Class A) | 1.82 | 3.23 | 0.7 | 25 | Crackled |
| TNT | 1.60 | 1.83 | 0.1 | 56 | No Reaction |

NEAK = 46% EDDN/39% NA/7% KN/8% NQ
EAK = 46% EDDN/46% AN 8% KN - This composition was prepared in similar manner to the process described above for NEAK except that NQ was omitted.

I claim:

1. A castable high explosive composition comprising a mixture of about from:

2 to 57 wt. % ammonium nitrate
2 to 50 wt. % ethylenediamine dinitrate
1 to 10 wt % potassium nitrate
1 to 80 st % nitroguanidine.

2. The explosive composition according to claim 1, wherein the amount of potassium nitrate is approximately 15% based on the combined weight of the ammonium nitrate and potassium nitrate.

3. The explosive composition according to claim 1, comprising a eutectic mixture of 57% ammonium nitrate
25% ethylenediamine dinitrate
10% potassium nitrate
8% nitroguanidine

4. The explosive composition according to claim 1, comprising a mixture of about 39% ammonium nitrate
46% ethylenediamine dinitrate
7% potassium nitrate
8% nitroguanidine.

5. The explosive composition of claim 1, 2 or 3, which additionally contains up to about 95% by weight of said mixture of at least one crystalline high explosive selected from the group consisting of 1,3,5-trinitro-1,3,5-triazacyclohexane, 1,3,5,7-tetranitro-1,3,5,7-tetraazacyclooctane, nitroguanidine, pentaerythritol tetranitrate and 2,4,6-trinitrotoluene.

6. The explosive composition of claim 4, which additionally contains up to about 25% powdered aluminum by weight of said mixture.

7. A cast explosive of the composition of claim 1.

8. A pressed explosive of the composition of claim 1.

9. A process for preparing a composition according to claim 1, which comprises slowly adding ethylenediamine to a mixture including aqueous nitric acid, ammonium nitrate and potassium nitrate, to form ethylenediamine dinitrate, adding nitroguanidine and removing water from the composition by distillation.

* * * * *